United States Patent [19]

Yamanashi

[11] Patent Number: 5,066,985

[45] Date of Patent: Nov. 19, 1991

[54] COLOR CORRECTED IMAGE RECORDING APPARATUS USING YELLOW, MAGENTA AND CYAN LIQUID TONERS

[75] Inventor: Motoaki Yamanashi, Nagoya, Japan

[73] Assignee: Brother Kogyo Kabushiki Kaisha, Japan

[21] Appl. No.: 497,208

[22] Filed: Mar. 22, 1990

[30] Foreign Application Priority Data

Mar. 22, 1989 [JP] Japan ..... 1-69856

[51] Int. Cl.[5] ..... G03G 15/01

[52] U.S. Cl. ..... 355/326; 355/256; 355/327; 359/891

[58] Field of Search ..... 350/311, 315, 317, 318; 355/245, 256, 326, 327, 71; 430/44, 45; 118/659, 660

[56] References Cited

U.S. PATENT DOCUMENTS 3,879,122 4/1975 Wick et al. ..... 355/327

4,690,541 9/1987 Sakai et al. ..... 355/327

FOREIGN PATENT DOCUMENTS 0013430 2/1978 Japan ..... 355/327

*Primary Examiner*—Arthur T. Grimley

*Assistant Examiner*—Christopher Horgan

*Attorney, Agent, or Firm*—Oliff & Berridge

[57] ABSTRACT

A color image recording apparatus for recording a color image of an original document on a photosensitive paper using at least yellow, magenta and cyan liquid toners respectively containing yellow, magenta and cyan color materials as primary color components. At least one of the three liquid toners contains foreign color materials which are the primary color components of the rest of two liquid toners. To reproduce the color image of the original document with maximum possible fidelity, a disk-shaped rotary filter is provided for receiving imaging light separated into blue, green and red light components and changing light transmission rates passing through the filter so as to be equal to the proportion of the color material to be reproduced which is contained in the yellow, magenta and cyan liquid toners. The light transmission rates are changed each time when one of the yellow, magenta and cyan liquid toners is used.

7 Claims, 2 Drawing Sheets

COLOR CORRECTED IMAGE RECORDING APPARATUS USING YELLOW, MAGENTA AND CYAN LIQUID TONERS

BACKGROUND OF THE INVENTION

The present invention relates generally to a color image recording apparatus, and more particularly to a wettype color image recording apparatus wherein a latent image formed on a photosensitive member is developed by using at least three liquid toners of yellow, magenta and cyan.

In a conventional color image recording apparatus of this kind, developing processes with yellow, magenta and cyan liquid toners are individually and sequentially performed. In the yellow toner developing process, light is irradiated onto an original document and the light reflected therefrom is passed through a filter to extract a blue light which is the complementary color of yellow. The blue light is applied onto a uniformly charged photosensitive member to form a latent image thereon. The latent image is then developed with the yellow toner to form a yellow image. The developing processes with magenta and cyan liquid toners are similarly performed, wherein green and red lights which are complementary colors of magenta and cyan, respectively, are applied onto the photosensitive member to form latent images corresponding respectively to the green and red lights and then the latent images are developed with the magenta and cyan liquid toners. Through the above-described processes, a full color image reproduction is achieved.

Although the yellow color is primarily reproduced by the yellow liquid toner, a small amount of the yellow color material is also contained in both the magenta and cyan liquid toners. Therefore, yellow color reproduction will not be faithfully achieved if the components of the yellow color material contained in the magenta and cyan liquid toners are not taken into consideration. For example, if reproduction is made with respect to an original document having two regions which are the same in yellow density but differ in both magenta and cyan densities, the two regions where the yellow color density should be reproduced at the same level will, in fact, be reproduced at different levels due to the influence of the yellow color materials contained in the magenta and cyan toner liquid.

SUMMARY OF THE INVENTION

The present invention has been made to obviate the above-described drawback, and accordingly it is an object of the present invention to provide a color image recording apparatus using three liquid toners of yellow, magenta and cyan wherein rates of the components of the foreign color materials contained in each of the liquid toners are taken into consideration to reproduce the colors on an original document with maximum possible fidelity.

To achieve the above and other objects of the present invention, there is provided a color image recording apparatus for recording a color image of an original document on a photosensitive paper using at least yellow, magenta and cyan liquid toners respectively containing yellow, magenta and cyan color materials as primary color components, at least one of the three liquid toners further containing the primary color components of the rest of two liquid toners as foreign color components, wherein the color image recording is separately and sequentially performed with respect to the yellow, magenta and cyan liquid toners, and wherein each time one of the liquid toners is used, the photosensitive paper is exposed to light to form a latent image thereon corresponding to the color image of the original document, the apparatus comprising scanning means for scanning the color image of the original document and providing an imaging light, charging means for uniformly charging the photosensitive paper, light separation means for separating the imaging light into blue, green and red light components, filter means for receiving the blue, green and red light components and changing light transmission rates through the filter means to equal rates of the color material to be used for reproduction which is contained in the yellow, magenta and cyan liquid toners, the light transmission rates being changed each time when the yellow, magenta and cyan liquid toners are selectively used, an optical unit for applying the blue, green and red light components passed through the filter means onto the photosensitive paper to form a latent image thereon corresponding to the color image of the original document, light paths of the blue, green and red light components being the same length, the blue, green and red light components passed through the filter means being focused on the same point on the photosensitive paper, and developing means for developing the latent image with the liquid toner containing the color material to be reproduced as the main color component.

According to the image recording apparatus thus arranged, the light separation means receives the light reflected from the original document, i.e. the imaging light, and separates it into blue, green and red light components. The optical unit serves to individually guide the blue, green and red light components to be focused onto the same point on the photosensitive paper. The optical path length of each of the blue, green and red light components are held equal to one another.

The filter means is, for example, in the form of a disk which is equally divided into first, second and third segments. Each segment is further divided into three filter elements adapted to receive the blue, green and red light components. The filter elements of the first segment are used when developing the latent image with the yellow liquid toner and the light transmission rate of each of the filter elements of the first segment is set equal to a proportion of the yellow color material contained in each of the yellow, magenta and cyan liquid toners, wherein the filter elements of the second segment are used when developing the latent image with the magenta liquid toner and the light transmission rate of each of the filter elements of the second segment is set to equal proportion of the magenta color material contained in each of the yellow, magenta and cyan liquid toners, and wherein the filter elements of the third segment are used when developing the latent image with the cyan liquid toner and the light transmission rate of each of the filter elements of the third segment is set equal to a proportion of the cyan color material contained in each of the yellow, magenta and cyan liquid toners. With the apparatus according to the present invention, half-tones of the original image can be particularly reproduced in good fidelity.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
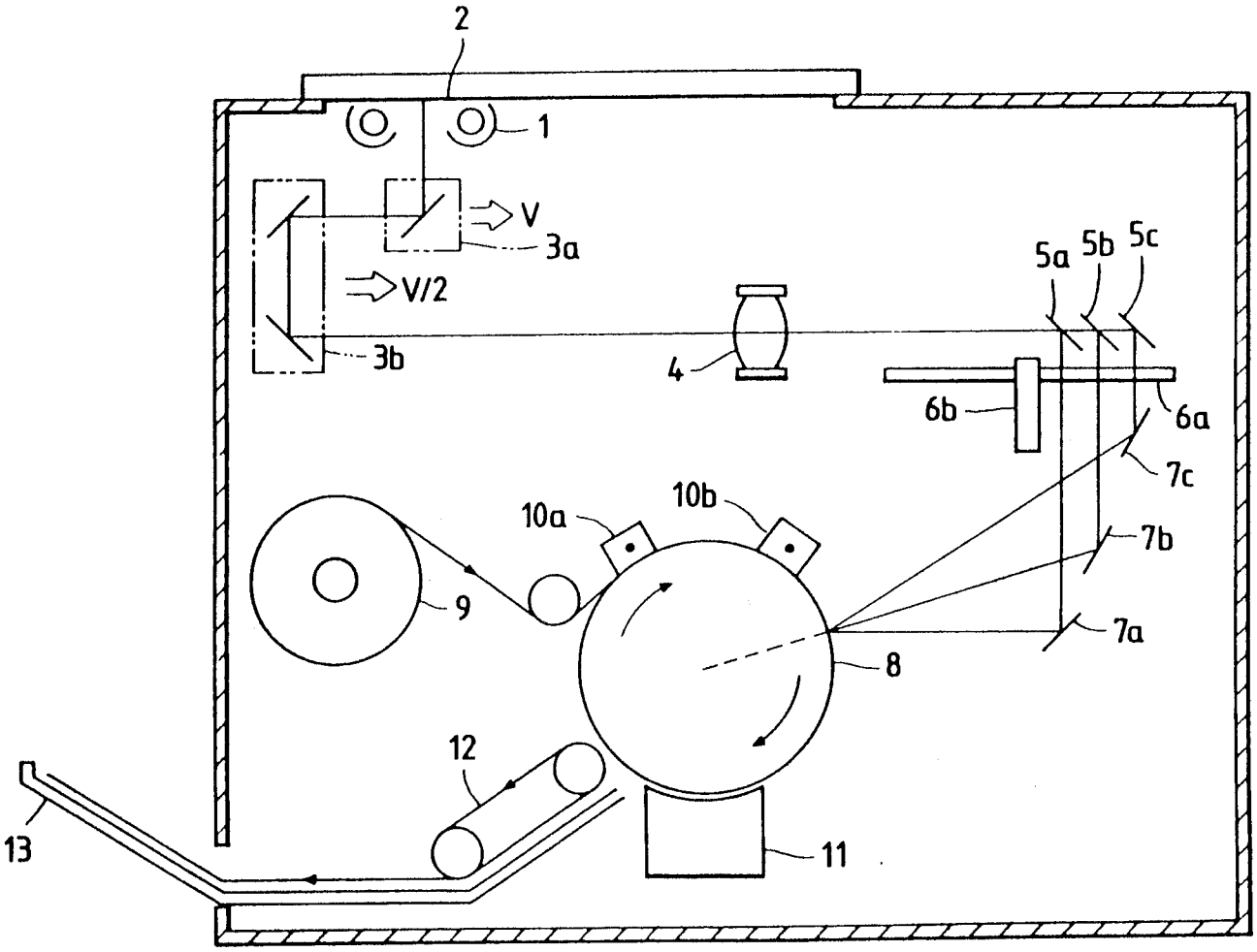
FIG. 1 is a schematic diagram showing a color image recording apparatus according to the present invention.
Figure 2:
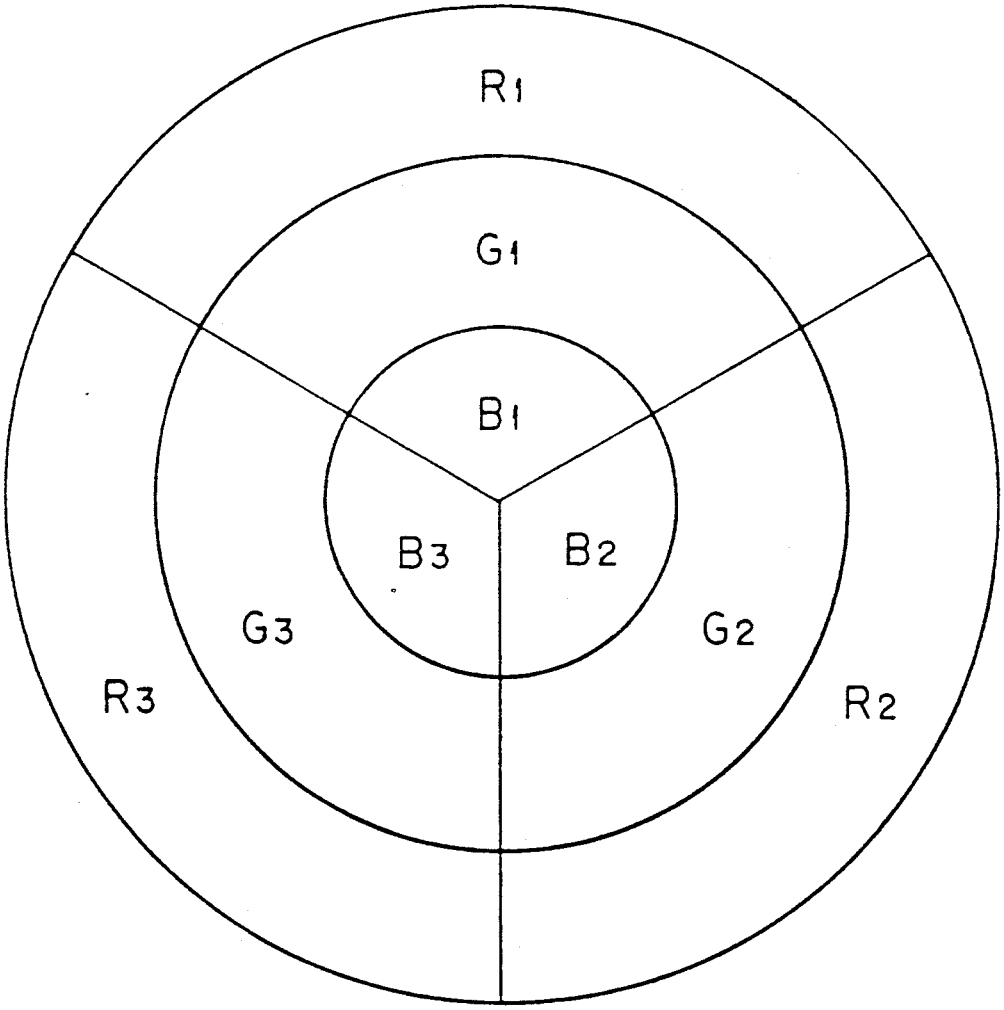
FIG. 2 is a schematic representation of the filter used in the image recording apparatus according to the present invention.

In the upper portion of a color image recording apparatus, there is provided an original support plane for placing an original document 2 thereon. In the interior of the apparatus, an optical system is provided which includes exposure lamps 1 for applying white light onto the original document 2, a mirror 3*a* for receiving the light reflected from the original document 2, a mirror unit 3*b* for changing the light path of the reflected light, a lens 4 for focusing the reflected light, dichromic mirrors 5*a* through 5*c*, a light transmission rate changing filter 6*a*, and mirrors 7*a* through 7*c*.

The exposure lamps 1, the mirror 3*a* and the mirror unit 3*b* are at rest below and leftwardly of (in the figure) the original support plane. For scanning the image on the original document 2, the exposure lamps 1 and the mirror 3*a* move rightwardly at a speed of V, and the mirror unit 3*b* moves rightwardly at a speed of V/2, to maintain the optical length constant.

The dichromic mirrors 5*a*, 5*b*, 5*c* are sequentially arranged on the optical path one behind the other. These mirrors serve to separate the imaging light into red, green and blue light components. Specifically, the mirror 5*a* receives the imaging light and reflects the blue light component which is in complementary color relation to yellow. However, the remaining components of the imaging light are allowed to pass therethrough. The mirror 5*b* receives the light passed through the mirror 5*a*, and reflects the green light component, which is in complementary color relation to magenta, and the residual red light component is allowed to pass through. The mirror 5*c* receives the red light component passed through the mirror 5*b* and reflects the same. The red light component is a complementary color to cyan. In this manner, the imaging light is separated into the blue, green and red light components by the mirrors 5*a*, 5*b* and 5*c*, respectively, and those light components are directed downwardly at the associated mirrors 7*a*, 7*b* and 7*c*.

The filter 6*a* is of a disk shape and is secured to a rotary shaft 6*b* and receives the blue, green and red light components at different locations. The filter 6*a* is rotated by a motor (not shown) coupled to the rotary shaft 6*b* and rotates 120 degrees at a time. The filter 6*a* is divided into three segments, each being further divided into three so as to be in positional correspondence to the mirrors 5*a*, 5*b* and 5*c*. Nine filter elements are therefore provided in total, each having a predetermined light transmission rate to be described later.

The lights passed through the filter 6*a* are reflected upon the associated mirrors 7*a*, 7*b* and 7*c* and are focused onto the same point on a photosensitive drum 8. The positions in which the mirrors 7*a*, 7*b* and 7*c* are disposed are determined so that the length of the optical path of each color component is set to be equal to one another.

The drum 8 is rotatable in the clockwise direction in the illustrated state. A photosensitive sheet 9 is unrolled from a roll and cut to a predetermined length by means of a cutter (not shown). The photosensitive sheet 9 is wound around the drum 8. A discharger 10*a* and a charger 10*b* are disposed along the periphery of the drum 8 and between a sheet entry position and the focusing position in confronting relation to the outer periphery of the drum 8.

Downstream of the focusing position, a developing unit 11 is disposed in which three toner tanks are separately arranged which are a yellow toner tank containing a yellow liquid toner, a magenta toner tank containing a magenta liquid toner and a cyan liquid toner tank containing a cyan liquid toner. A photosensitive sheet conveyor belt 12 and a discharge tray 13 are also disposed along the periphery of the drum 8 downstream of the developing unit 11.

In the yellow liquid toner, yellow color material is contained 100% and substantially no foreign color materials, i.e. magenta and cyan color materials, are contained therein. In the magenta liquid toner, magenta color material is contained 60% as a primary component and foreign color materials are contained 40% in which yellow color material occupies 35% and cyan color material 5%. In the cyan liquid toner, cyan color material is contained 45% and foreign color materials are contained 55% in which yellow color material occupies 20% and magenta color material 35%. The foregoing rates of the respective color materials contained in each of the liquid toner are shown by way of example and such rates change depending upon the manufactures.

Operation of the apparatus thus arranged will next be described.

In the state where an original document 2 with a color image thereon is placed face down on the original support plane, a start switch (not shown) is depressed. The, the exposure lamps 1 are lit and move rightwardly together with the mirror 3*a* and the mirror unit 3*b* for scanning the image face of the original document 2. The light reflected from the original document 2, i.e. imaging light, is separated into blue, green and red color components by the dichromic mirrors 5*a*, 5*b* and 5*c*, respectively, and the light components thus separated are entered into the filter 6*a*.

In this apparatus, developing processes with yellow, magenta and cyan liquid toners are separately and sequentially carried out. In each developing process, the scanning of the original document 2 and separation of the imaging light are repeatedly performed.

In the yellow liquid toner developing process, three filter elements $B_1$, $G_1$ and $R_1$ of the first segment of the filter 6*a* are placed in positional correspondence to the mirrors 5*a*, 5*b* and 5*c*, respectively. The light transmission rates of those filter elements $B_1$, $G_1$ and $R_1$ are selected to 100%, 35% and 20%, respectively, so that the amount of the blue light component is entirely allowed to pass through the filter element $B_1$, the amount of green light component is reduced to 35%, and the amount of the red light component is reduced to 20%. In the magenta liquid toner developing process, the second segment of the filter 6*a* is disposed in the optical path by rotating the filter 6*a* 120 degrees and another three filter elements $B_2$, $G_2$ and $R_2$ are placed in positional correspondence to the mirrors 5*a*, 5*b* and 5*c*, respectively. The light transmission rates of the filter elements $B_2$, $G_2$ and $R_2$ are selected to 0%, 60% and 35%, respectively, so that the blue light component is completely interrupted, the amount of green light component is reduced to 60%, and the amount of the red light component is reduced to 35%. Likewise, in the cyan liquid toner developing process, the third segment of the filter 6a is disposed in the optical path by rotating the filter 6a further 120 degrees and the rest of the three filter elements $B_3$, $G_3$ and $R_3$ are placed in positional correspondence to the mirrors 5a, 5b, and 5c, respectively. The light transmission rates of the filter elements $B_3$, $G_3$ and $R_3$ are selected to 0%, 5% and 45%, respectively, so that the blue light component is completely interrupted, the amount of the green light component is reduced to 5%, and the amount of the red light component is reduced to 45%. The foregoing light transmission rates are shown by way of example only. It should be noted that the above-mentioned light transmission rates are determined so that gray color on the original document can be reproduced with a possible maximum fidelity, wherein equal amounts of blue, green and red light components are received in the filter 6a.

As described, the light transmission rate of each of the filter elements $B_1$, $G_1$ and $R_1$ used in the developing process with yellow liquid toner is set equal to the proportion of the yellow color material contained in each of the yellow, magenta and cyan liquid toners. Similarly, the light transmission rate of each of the filter elements $B_2$, $G_2$ and $R_2$ used in the developing process with the magenta liquid toner is set equal to the proportion rate of the of the magenta color material contained in each of the yellow, magenta and cyan liquid toners. The light transmission rate of each of the filter elements $B_3$, $G_3$ and $R_3$ used in the developing process with the cyan liquid toner is set equal to the proportion rate of the quantity of the cyan color material contained in each of the yellow, magenta and cyan liquid toners.

In the developing process with the yellow liquid toner, the light from the filter 6a is irradiated onto the photosensitive paper 9 which has been uniformly charged. The photosensitive paper 9 is therefore exposed to the light and a latent image is formed thereon. The latent image is then developed with the yellow liquid toner. In similar fashion, developments with magenta and cyan liquid toners are sequentially performed. After all the developing processes are finished, the photosensitive paper 9 is discharged onto the discharge tray 13 while being conveyed by the conveyor belt 12.

Although the present invention has been described with reference a specific example, it would be apparent for those skilled in the art that various changes and modifications may be made without departing from the scope and spirit of the present invention.

What is claimed is:

1. A color image recording apparatus for recording a color image of an original document on a photosensitive paper using at least yellow, magenta and cyan liquid toners respectively containing yellow, magenta and cyan color materials as primary color components, at least one of the three liquid toners further containing the primary color components of the rest of two liquid toners as foreign color components, wherein the color image recording is separately and sequentially performed with respect to the yellow, magenta and cyan liquid toners, and wherein each time one of the liquid toners is used, the photosensitive paper is exposed to light to form a latent image thereon corresponding to the color image of the original document, the apparatus comprising:

scanning means for scanning the color image of the original document and providing an imaging light;

charging means for uniformly charging the photosensitive paper;

light separation means for separating the imaging light into blue, green and red light components;

filter means for receiving the blue, green and red light components and changing light transmission rates passing through said filter means so as to be equal to a proportion of that color material to be used for reproduction which is contained in the yellow, magenta and cyan liquid toners, the light transmission rates being changed each time when one of the yellow, magenta and cyan liquid toners is used;

an optical unit for applying the blue, green and red light components passed through said filter means onto the photosensitive paper to form a latent image thereon corresponding to the color image of the original document, light paths of the blue, green and red light components being the same length, the blue, green and red light components passed through said filter means being focused on the same point on the photosensitive paper; and developing means for developing the latent image with the liquid toner containing the color material to be reproduced as the main color component.

2. A color image recording apparatus according to claim 1, wherein said filter means includes a disk-shaped filter equally divided into first, second and third segments, each segment containing three filter elements for receiving the blue, green and red light components and being used when development with each of the three liquid toners is used.

3. A color image recording apparatus according to claim 2, wherein the filter elements of the first segment is used when developing the latent image with the yellow liquid toner and the light transmission rate of each of the filter elements of the first segment is set equal to a proportion of the yellow color material contained in each of the yellow, magenta and cyan liquid toners, wherein the filter elements of the second segment is used when developing the latent image with the magenta liquid toner and the light transmission rate of each of the filter elements of the second segment is set equal to a proportion of the magenta color material contained in each of the yellow, magenta and cyan liquid toners, and wherein the filter elements of the third segment is used when developing the latent image with the cyan liquid toner and the light transmission rate of each of the filter elements of the third segment is set equal to a proportion of the cyan color material contained in each of the yellow, magenta and cyan liquid toners.

4. A color image recording apparatus according to claim 1, wherein said light separation means comprises three dichromic mirrors for discretely reflecting the blue, green and red light components.

5. A color recording apparatus according to claim 1, wherein said filter means comprises a first segment, a second segment and a third segment, each segment containing three filter elements for receiving the blue, green and red light components and being used when development with each of the three liquid toners is used.

6. A color recording apparatus according to claim 5, wherein the filter elements of the first segment are used when developing the latent image with the yellow liquid toner and the light transmission rate of each of the filter elements of the filter segment is set equal to a proportion of the yellow color material contained in each of the yellow, magenta and cyan liquid toners, wherein the filter elements of the second segment are used when developing the latent image with the magenta liquid toner and the light transmission rate of each of the filter elements of the second segment is set equal to a proportion of the magenta color material contained in each of the yellow, magenta and cyan liquid toners, and wherein the filter elements of the third segment are used when developing the latent image with cyan liquid toner and the light transmission rate of each of the filter elements of the third segment is set equal to a proportion of the cyan color material contained in each of yellow, magenta and cyan liquid toners.

7. A color image recording apparatus according to claim 5, wherein said light separation means comprises three dichromic mirrors for discretely reflecting the blue, green and red light components.

* * * * *